United States Patent [19]

Cappa et al.

[11] Patent Number: 4,961,420

[45] Date of Patent: Oct. 9, 1990

[54] GAS MASK FOR OPERATION IN CONTAMINATED AREAS

[75] Inventors: Giulio Cappa, Milan; Romano Moscatelli, Rome; Paolo La Torre, Genzano di Roma, all of Italy

[73] Assignees: Industrie Pirelli S.p.A.; Minestero Della Difesa Direzione Generale A.M.A.T., both of Italy

[21] Appl. No.: 315,469

[22] Filed: Feb. 24, 1989

[30] Foreign Application Priority Data

Feb. 26, 1988 [IT] Italy ..... 19558 A/88

[51] Int. Cl.[5] ..... A62B 7/10; A62B 18/10; A62B 18/04; A62B 18/08

[52] U.S. Cl. ..... 128/207.12; 128/206.24; 128/206.28; 128/206.22; 128/206.12; 128/206.15; 128/206.17; 128/201.19

[58] Field of Search ..... 128/201.21, 201.22, 128/201.23, 201.24, 201.25, 201.28, 201.29, 202.15, 206.12, 206.15, 206.17, 206.22, 206.24, 206.27, 206.28, 207.12, 201.13, 201.15, 201.19

[56] References Cited

U.S. PATENT DOCUMENTS

| | | | |
|---|---|---|---|
| 1,509,319 | 9/1924 | Saunier | 128/201.15 |
| 1,762,695 | 6/1930 | Monro | 128/201.15 |
| 2,307,730 | 1/1943 | Heribert | 128/207.12 |
| 2,381,568 | 8/1945 | Booharin | 128/201.15 |
| 2,695,020 | 11/1954 | Glidden | 128/201.15 |
| 2,810,386 | 10/1957 | Reed | 128/201.28 |
| 2,898,908 | 8/1959 | Sovinsky | 128/206.15 |
| 3,181,531 | 5/1965 | Angioletti | 128/201.15 |
| 3,220,408 | 11/1965 | Silverberg | 128/206.15 |
| 3,540,442 | 11/1970 | Holloway | 128/207.12 |
| 3,602,219 | 8/1971 | Warncke | 128/201.15 |
| 4,595,003 | 6/1986 | Shoemaker et al. | 128/201.25 |
| 4,756,308 | 7/1988 | Ryback | 128/207.12 |
| 4,764,990 | 8/1988 | Markert | 128/201.15 |
| 4,850,346 | 7/1989 | Michel et al. | 128/207.12 |

FOREIGN PATENT DOCUMENTS

| | | | |
|---|---|---|---|
| 0238129 | 9/1987 | European Pat. Off. . | |
| 2329668 | 2/1975 | Fed. Rep. of Germany | 128/201.28 |
| 740359 | 1/1933 | France . | |
| 801610 | 5/1936 | France | 128/201.15 |
| 802211 | 6/1936 | France | 128/201.15 |
| 831668 | 6/1938 | France | 128/207.12 |
| 2043022 | 2/1971 | France . | |
| 0138036 | 10/1979 | German Democratic Rep. | 128/207.12 |
| 628594 | 11/1961 | Italy | 128/207.12 |
| 84872 | 11/1935 | Sweden | 128/206.15 |

*Primary Examiner*—Edgar S. Burr
*Assistant Examiner*—Kimberly L. Asher
*Attorney, Agent, or Firm*—Stevens, Davis, Miller & Mosher

[57] ABSTRACT

A gas mask is provided which includes a facepiece including a front portion of semi-rigid rubber highly resistant to chemical agents and a sealing skirting of soft rubber having a high mechanical resistance, co-vulcanized with the front portion of the facepiece. A nozzle, connected to a half mask situated inside the facepiece, is tightly fastened to the front portion of the facepiece. An inflow opening and an outflow opening are provided which are substantially coaxial and are located in the lower portion of the nozzle. The inflow opening places the interior of the facepiece into communication with the external atmosphere and the outflow opening places the interior of the half mask into communication with the external atmosphere through an inflow chamber and an outflow chamber which are separated by a partition. The inflow chamber communicates bilaterally with a space located between the half mask and the facepiece. The outflow chamber communicates with the external atmosphere, over the inflow opening, and in front of the phonic cap assembled in the upper part of the nozzle.

13 Claims, 3 Drawing Sheets

GAS MASK FOR OPERATION IN CONTAMINATED AREAS

FIELD OF THE INVENTION

The present invention relates to a gas mask for operation in contaminated areas. This type of gas mask finds a large employment in the event of natural calamities, industrial accidents, and/or in any situation in which the user's survival must be ensured even in the presence in the area of highly noxious substances, be they in the form of gases, aerosols or powders.

BACKGROUND OF THE INVENTION

As known, gas masks intended for the above-described use comprise substantially a facepiece made of impermeable material, resistant to chemical agents and associated with a harness which allows the mask to be put on the user's head so as to provide a tight seal between the edges of the facepiece and the user's face.

Once the mask is put on, the user can inhale air from the outside through an inflow opening arranged on the facepiece and provided with a threaded fitting on which is assembled a filtering element intended to decontaminate the air being inhaled. The air subsequently exhaled by the user is expelled from the mask through an outflow opening, also arranged on the facepiece and provided with a respective single-acting valve.

The facepiece comprises, moreover, two eye-pieces or, alternatively, a single transparent screen to give the user full visibility. To prevent the air being breathed out from causing clouding of the eye-pieces, in many cases, provision is made of a so-called "half mask," associated with the facepiece and communicating with the outside through the outflow opening and the single-acting valve.

The half mask allows the air breathed out to be directly discharged outside without filling completely the inner portions of the facepiece, in particular those corresponding to the eye-pieces. Still, in order to prevent a possible clouding of the eye-pieces, it is foreseen that, in the inhalation phase, the air flow inhaled through the filter may be guided into the inner portions of the facepiece so as to skim the surfaces of the eye-pieces and to be then sucked inside the half mask through further check valves.

In this way, also, the clouding of the eye-pieces due to the user's perspiration is significantly reduced.

Generally, the facepiece includes also a phonic cap, functioning to transmit outside the user's voice to prevent an excessive muting of the same owing to the presence of the facepiece.

In masks of modern design, both the inflow and the outflow openings are obtained in a so-called "nozzle," tightly engaged in the lower portion of the facepiece and housing also the phonic cap. More particularly, the inflow opening is provided in the upper part of the nozzle and flows almost directly, by means of a short connection duct, into the interior of the facepiece, at the base of the eye-pieces and in a median position between them.

The outflow opening is instead provided in the lower part of the nozzle and opens directly outside the mask, below the inflow opening. The phonic cap is situated over the inflow opening and is directed toward a chamber placed behind the connection duct and communicating with the outlet of the outflow opening downstream of the corresponding single-acting valve.

It has been noted that the arrangement of the above-described elements yields certain inconveniences regarding the practical and functional employment of the gas mask. At first, it can be seen that the position of the inflow opening involves a corresponding position of the filtering element which is not quite appropriate in view of a rational distribution of the mask portion. In fact, the filtering element, which is situated in the upper part of the nozzle and has a considerable weight, may provide high moments of inertia opposing movements of the user's head. In this situation, a comfortable use of the mask is compromised. Further, the position of the filtering element limits the user's downward field of view.

It was also noted that the position of the inflow opening limits the possibility of building up the facepiece in such a way that the eye-pieces are sufficiently near the user's eyes to permit the use of binoculars, microscopes or optical instruments in general, when the mask is worn.

Moreover, the direct connection between the inflow opening and the interior of the facepiece can cause some problems if the mask is to be used at low temperatures. In fact, in these circumstances, the inhaled air cannot be heated before skimming the user's face, giving, therefore, rise to a significant discomfort level for the user.

Furthermore, the entrance of air at the base of the eye-pieces, in a median portion between them, does not represent an ideal condition to obtain an optimum distribution of the air flow inside the facepiece. This can result in an irregular de-clouding of the eye-pieces. It is also to be noted that the air skimming the surface of the eye-pieces is not heated at all, so that it is not in the best condition to yield an efficient de-clouding function.

Another disadvantage of the prior art is that the air coming out from the outflow opening tends to skim the surfaces of the filtering element. At low temperatures and after a prolonged use of the mask, this circumstance can cause formation of a certain amount of ice on the filtering element, due to freezing of the water molecules present in the exhaled air. The consequent increase in the weight of the filtering element compromises therefore the comfort, and above all the safety, of the mask.

The position of the phonic cap, situated behind the inflow opening, affects significantly a good transmission of the user's voice toward the outside. In fact, the user's voice is compelled to reach the outflow opening and to come out below the filtering element. To compensate for the poor quality of this transmission, it is at present necessary to provide large-sized phonic caps, to the detriment of the space available for the single-acting valve associated with the outflow opening.

In this condition, the diameter of the single-acting valve must be considerably reduced, with a consequent increase in the effort required by the user to expel air from the mask. Alternatively, the single-acting outflow valve can have an elongated configuration, involving, however, high production costs and giving results, as to an efficient and reliable employment, which are anyhow worse than those obtainable by the use of circular valves of appropriate diameter.

In the production of masks according to the conventional technique, some problems arise from the contrasting needs of providing facepieces which must be sufficiently stiff to prevent excessive oscillations of the unit formed by the nozzle and the filtering element and which must be, at the time, sufficiently soft and elastic to ensure a perfect sealing action around the user's face.

Generally, these objectives are satisfied by making the facepiece with soft rubber layers having a reduced thickness along the edges to be sealed around the user's face and a greater thickness, to provide additional stiffness, in the front portions of the facepiece. These expedients, however, result in a significant increase in the overall mask weight and, therefore, may compromise its comfort, in particular in view of a prolonged use.

Attempts to eliminate such disadvantages have led to the production of facepieces whose front portions are reinforced with fabric layers embedded in the rubber. However, this requires long and complicated procedures, not suitable for mass production.

Also, masks were built up, whose facepieces comprise two portions stuck together. A first portion, which extends around the edges of the facepiece, functions to ensure a seal around the user's face and is therefore made of soft rubber, and the remaining portion of the facepiece is made of stiffer rubber. This solution involves problems regarding reliability of use, since the mask may be employed in atmospheres containing solvents able to attack chemically the bonding agents used to join the two portions forming the facepiece.

SUMMARY OF THE INVENTION

The primary objective of the present invention is substantially to eliminate the above-noted disadvantages of the conventional masks, and in particular, to provide a gas mask having improved characteristics of comfort, versatility and functionality, even for long periods of continuous use in unfavorable atmospheric conditions.

The above and other purposes, which will be more clearly apparent from the following detailed description, are substantially achieved by means of a gas mask for operation in contaminated areas, wherein (1) the phonic cap is situated in an upper portion of the nozzle, (2) the inflow opening is provided in a lower portion of the nozzle and is in communication with the interior of the facepiece through an inflow chamber which opens bilaterally in a lower portion of the facepiece, and (3) the outflow opening is obtained in the lower portion of the nozzle substantially at the level of the inflow opening and is in communication with the external atmosphere through an outflow chamber opening into a communication chamber, which opens in turn over the inflow opening at the level of the phonic cap, with the inflow and outflow chambers being mutually separated by a partition extending inside the nozzle.

The invention is directed to a gas mask comprising (1) a facepiece, (2) a nozzle tightly engaged in a lower portion of the facepiece, (3) a half-mask situated inside the facepiece, tightly engaged on the nozzle and provided with a terminal edge intended to provide a seal around the user's nose and mouth, (4) connection means to allow passage of air from the interior of the facepiece to the interior of the half-mask, (5) an inflow opening provided in the nozzle, including a fitting for assembling a filter and communicating with the interior of the facepiece, (6) closing valve means associated with the inflow opening, (7) an outflow opening placing the interior of the half-mask into communication with the external atmosphere, (8) a single-acting outflow valve associated with the outflow opening and (9) a phonic cap housed in the nozzle.

BRIEF DESCRIPTION OF THE DRAWINGS

Further characteristics and advantages of the disclosure will be more fully apparent from the detailed description of a preferred but not exclusive embodiment of a gas mask for operation in contaminated areas, in accordance with the present invention, made herebelow with reference to the attached drawings given only by way of non-limiting example, in which.

DETAILED DESCRIPTION OF THE PREFERRED EMBODIMENTS

Figure 3:
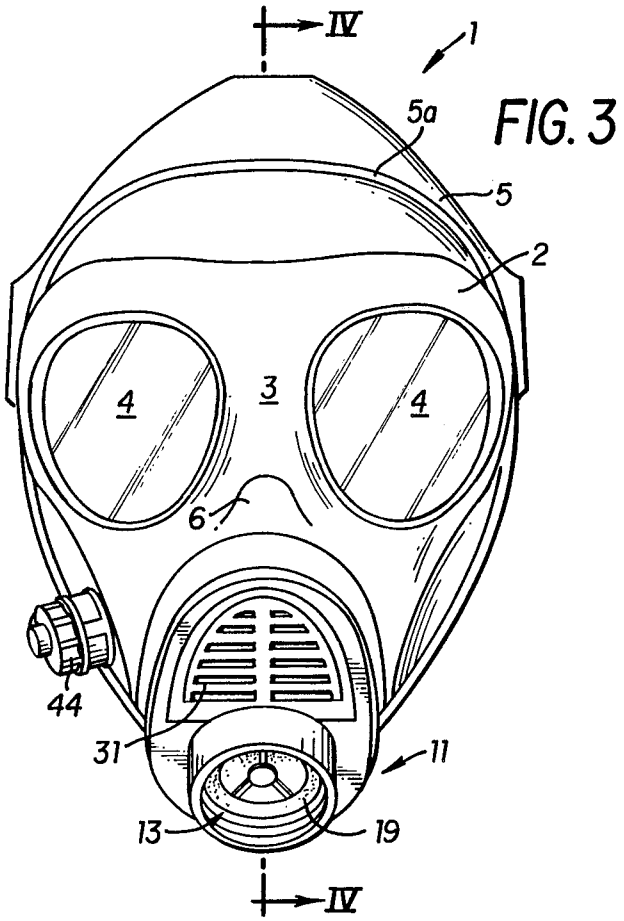
FIG. 3 is a front view of the mask.
Figure 4:
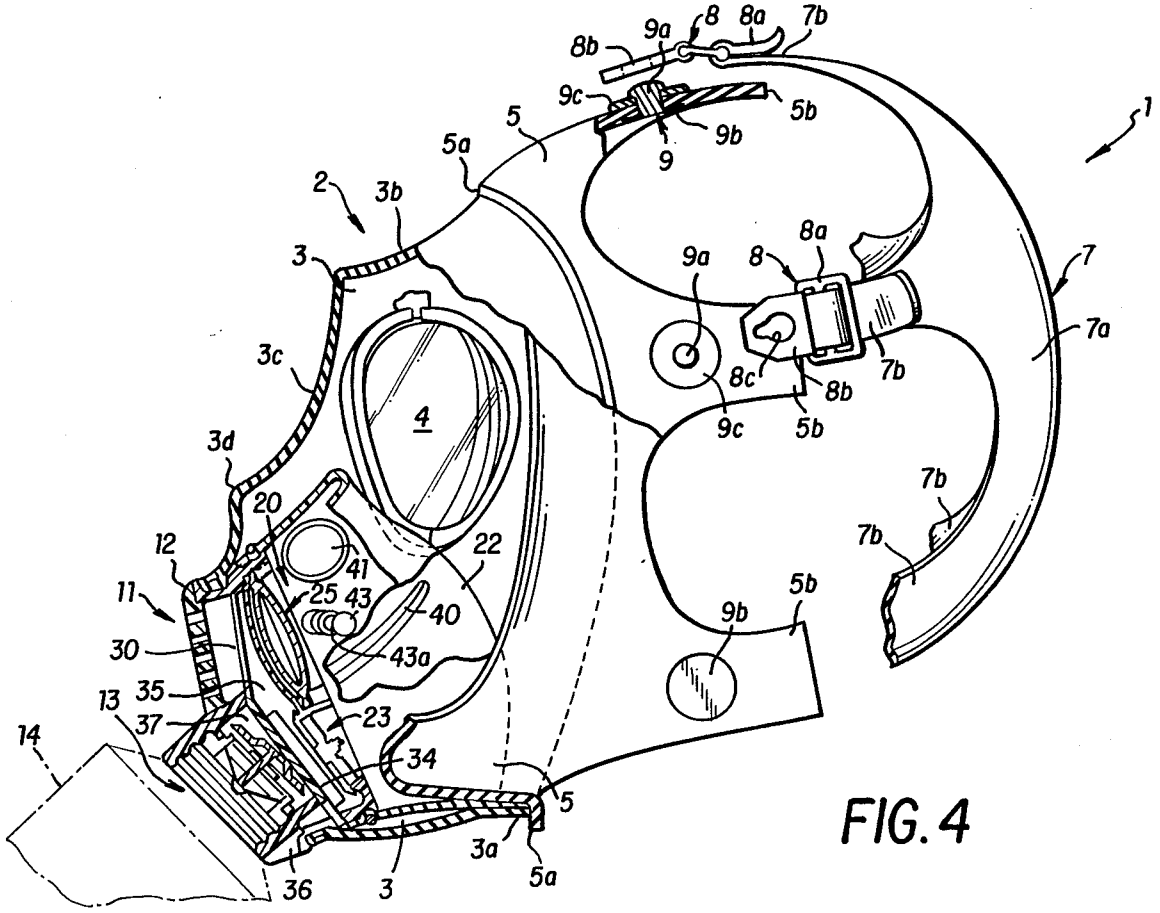
FIG. 4 is a broken sectional view of the mask according to the invention, taken along line IV—IV of FIG. 3.

With particular reference to FIGS. 3 and 4, reference numeral 1 refers to a gas mask for operation in contaminated areas in accordance with the present invention.

Mask 1 comprises a facepiece 2 having a front portion 3 intended to cover entirely the face of a user and conventionally provided with eye-pieces 4. A sealing skirting 5 is fastened along a peripheral edge 3*a* of front portion 3; skirting 5 extends toward the interior of front portion 3 and is intended to ensure a tight seal around the user's face.

Front portion 3 is made of semirigid rubber, having a hardness ranging between 50 and 70 Shore A, and highly resistant to chemical agents, be they in the form of gases, liquids, aerosols or powders. For instance, butyl rubber can be used to build up front portion 3.

Sealing skirting 5 is instead made of a rubber of high softness and elasticity, having preferably a hardness ranging between 40 and 70 Shore A, and a high mechanical resistance to tearing. For instance, natural rubber can be used to build up sealing skirting 5.

Advantageously, sealing skirting 5 is vulcanized together with the front portion 3 such that it is joined to the edge of front portion 3 of facepiece 2.

At edge 3*a*, sealing skirting 5 forms a peripheral step 5*a* intended to reinforce the area of union between the two compounds and to provide an abutment seat for the terminal edge of a hood (not illustrated) making part of a garment of the kind conventionally adopted to carry out operations in contaminated areas. Peripheral step 5*a* is advantageously able to avoid any incidental slipping off of the hood from the user's head.

Further, to prevent the hood edge from unduly covering eyepieces 4, the profile of front portion 3, cutoff along a vertical median plane, comprises a first section 3*b* (as shown in FIG. 4) which projects frontally with respect to sealing skirting 5, thus providing a wide supporting seat for said edge.

Conveniently, first section 3*b* is followed by a second section 3*c* which extends almost vertically, terminating with a ridge 3*d*. Due to the combination of first section 3*b* and second section 3*c*, front portion 3, at the latter, is very close to the user's face.

Therefore, eye-pieces 4 are situated a very short distance from the user's eyes, so that he may use optical instruments, such as microscopes, binoculars and so on, even when the mask is worn, this being facilitated by the absence of any protuberance external to his eyes which may interfere with the structure containing said optical instruments. For this purpose, protruding section 3c is entirely situated below the level of the user's pupils.

As visible in FIG. 3, ridge 3d originates a pinching protrusion 6 which, when the mask is worn, is situated around the user's nose. Protrusion 6 enables the user to stop his nostrils to effect a decompression if, during his work, he should be subjected to variations of atmospheric pressure.

Facepiece 2 is, moreover, provided with a flexible hose 43 engaged through one side of front portion 3 and comprising a closing member 44 arranged externally to mask 1. Hose 43, normally arranged along the corresponding inner side of mask 1, is able to engage, after the opening of closing member 44, a tubular rigid element, not illustrated, to be oriented such that its free end 43a is brought to the level of the user's mouth.

In this way, the user, still with the mask on, can drink water or nourishing liquids supplied by a container associated with said tubular rigid element.

In a conventional manner, facepiece 2 is secured to the user's face by means of a harness 7 (FIG. 4), substantially composed of a cap 7a from whose edges are initiated braces 7b, each provided with a respective gripping element 8. Each gripping element 8 comprises a buckle 8a on which is fixed a respective brace 7b, and an orientable loop 8b comprising a hole 8c by which it can be removably engaged with a respective button 9 fixed to an extension 5b of sealing skirting 5.

Button 9 comprises a pin-shaped element 9a which passes through a corresponding extension 5b and is provided with an abutment base 9b abutting against extension 5b. A retainer 9c, shaped as a circle ring and secured to pin 9a by a force engagement, acts against extension 5b at the opposite side with respect to base 9b to fasten button 9 to sealing skirting 5.

Front portion 3 of facepiece 2 includes in its lower part an opening through which a nozzle 11 is tightly locked by means of a strap 10. Nozzle 11 comprises a front portion 12, facing toward the outside of mask 1, around which is sealed the edge of said opening.

The lower part of front portion 12 includes an inflow opening 13 positioned so as to be substantially situated at the level of the user's mouth; opening 13 is provided with a threaded fitting 13a to allow the connection of a conventional filtering device 14, illustrated in the figures but not described in detail.

Inflow opening 13 communicates with the interior of facepiece 2, as will be described in more detail below, and is provided with closing valve means functioning to prevent any inhalation of external air on the user's part during the substitution of filtering device 14.

The closing valve means comprise a check valve 15, having a diaphragm 15a which can be subjected to the action of a small plate 16 fixed to the end of a stem 17 which is subjected to the action of a spring 18 which operates to bring plate 16 against diaphragm 15a. Further, a rubber ring 19 is connected to stem 17, at the side opposite to plate 16, by means of spokes 19a.

Figure 1:
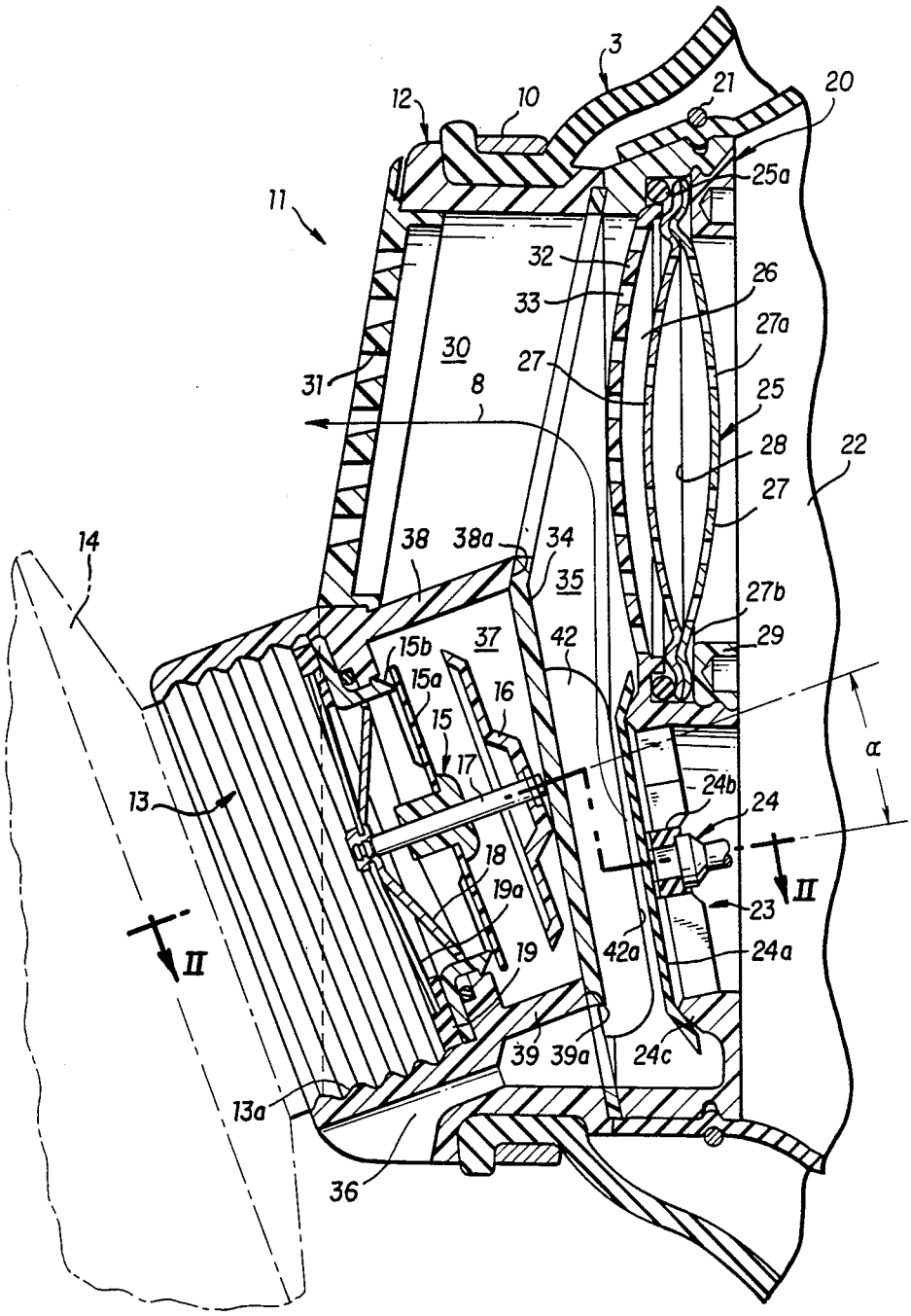
FIG. 1 is a broken longitudinal sectional view of the nozzle of the mask according to the present invention.

When filtering device 14 is correctly assembled, ring 19 is pushed in the direction of valve 15 as illustrated in FIG. 1. In this situation, plate 16 is spaced apart from diaphragm 15a, which is able to carry out its action directed to open or close valve 15.

On the other hand, when filtering device 14 is disengaged from mask 1, the action of spring 18 causes the detachment of ring 19 from valve 15 and brings plate 16 into contact with diaphragm 15a. As a result, diaphragm 15a is continuously pressed against a corresponding sealing seat 15b, so as to prevent the inhalation of air inside mask 1.

Figure 2:
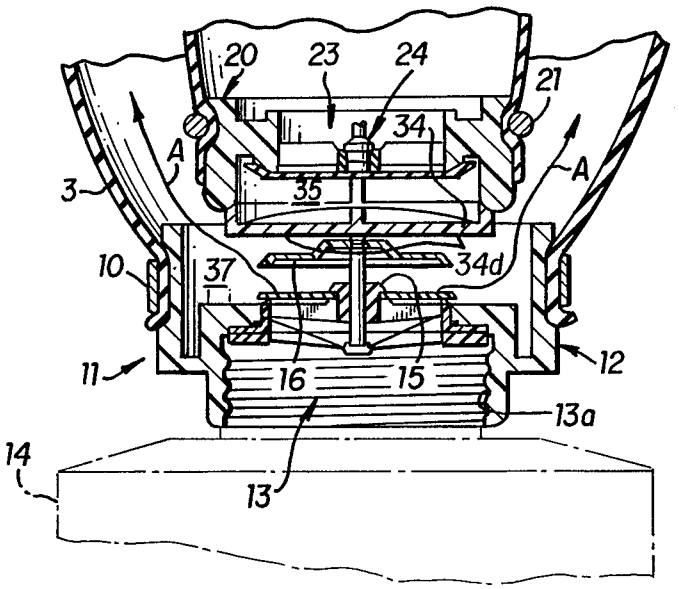
FIG. 2 shows the nozzle cutaway along line II—II of FIG. 1.

Nozzle 11 comprises, moreover, a rear portion 20, facing toward the inside of mask 1 and having, as shown in FIG. 2, a width smaller than that of front portion 12. A half mask 22 is tightly engaged, by means of a fastening ring 21, around rear portion 20; it is intended to exert a tight seal around the user's nose and mouth and flexible hose 43 passes therethrough.

The lower part of rear portion 20 comprises an outflow opening 23 provided with a respective single-acting outflow valve 24. Outflow valve 24 is conventionally formed by a rubber diaphragm 24a fixed to a support 24b and acting to seal a projection 24c which extends around the edge of outflow opening 23 externally to half mask 22. As clearly shown in FIGS. 1 and 2, outflow opening 23 is, in a novel and advantageous manner, arranged at the level of inflow opening 13 and is oriented in a direction substantially parallel to it.

In the illustrated embodiment, the axis of outflow opening 23 is inclined with respect to the axis of inflow opening 13 through an angle $\alpha$ smaller than 15° and more precisely preferably equal to 10°.

Further, rear portion 20 includes a phonic cap 25 tightly engaged, through an O-ring 25a, in a housing 26 provided over outflow opening 23. In a conventional way previously known per se, phonic cap 25 substantially comprises two half-shells 27 having respective holes 27a distributed along concentric circumferences and mutually fastened together by means of a seam 27b extending along a peripheral edge.

A diaphragm 28 is interposed between the two half-shells 27; during the formation of seam 27b, it is radially stretched so as to vibrate, without originating resonance phenomena, when subjected to acoustic vibrations comprised in the frequency range of the human voice. Phonic cap 25, maintained in position by a locking nut 29 screwed in housing 26, faces toward the inside of half mask 22 and, at the opposite side, faces towards a communication opening or chamber 30 which extends through the upper portion of nozzle 11. Communication opening 30 opens toward the outside over inflow opening 13, through a protection grate 31 removably connected to front portion 12 to prevent the penetration of foreign bodies into nozzle 11.

Advantageously, between phonic cap 25 and communication opening or chamber 30 is provided a separation wall 32 formed as a single piece in rear portion 20 and provided with a plurality of holes 33 distributed along concentric circumferences, offset with respect to the circumferences along which are distributed the above indicated holes 27a. This arrangement is provided to protect diaphragm 28 from possible luminous or thermal flashes and from pressure waves.

Rear portion 20 is made integral with front portion 12 via the interposition of a partition 34, whose peripheral extent is substantially coincident with that of rear portion 20. In a preferred embodiment, front portion 12 and rear portion 20, as well as partition 34, are made of synthetic resin and are mutually tightly connected by melting the material along the coupling surfaces at the points of mutual contact.

Partition 34, with respect to rear portion 20, originates an outflow chamber 35 which communicates with the interior of half mask 22 through outflow opening 23 and with the external atmosphere through communication opening 30. Further, at the base of nozzle 11, outflow chamber 35 extends into a discharge duct 36 which passes through partition 34 and front portion 12 and comes out from the latter below inflow opening 13.

With respect to front portion 12, the presence of partition 34 originates an inflow chamber 37 which communicates with inflow opening 13 through inlet valve 15. Inflow chamber 37, tightly separated from outflow chamber 35 by virtue of partition 34, is contained between an upper wall 38 and a lower wall 39, formed in a single piece construction with front portion 12, extending along the whole width of the latter and provided with respective terminal edges 38*a*, 39*a*, tightly connected on partition 34. Upper wall 38 separates in a tight manner inflow chamber 37 from communication chamber 30, and lower wall 39 separates in a tight manner said inflow chamber from discharge duct 36.

As can be seen in FIG. 2, since the width of rear portion 20 and that of partition 34 are smaller than the width of front portion 12, inflow chamber 37 opens bilaterally into the lower part of facepiece 2, in the space formed between the inner walls of the latter and the outer walls of half mask 22.

During normal use of gas mask 1, the vacuum originated inside half mask 22 by the user's inhalation causes the intake of air from the outside through filtering element 14. The air penetrating into nozzle 11 through inflow opening 13 strikes wall 34*d* of the partition in the zone opposite to that from which the partition is skimmed by the air exhaled by the user.

When the mask is to be used at low temperatures, the air conveyed into inflow chamber 37 would be advantageously ready to receive heat from the wall of partition 34, heated by the exhaled air. Subsequently, the inhaled air is conveyed into the free space between facepiece 2 and half mask 22, as indicated by arrow A in FIG. 2.

Advantageously, half mask 22 can be provided, at symmetrically opposite parts, with two guiding baffles 40, only one of which is shown in FIG. 4, which are positioned over inflow chamber 37, project toward facepiece 2 and extend symmetrically along half mask 22. The presence of baffles 40 prevents the air conveyed to the base of facepiece 2 from penetrating immediately into the upper portions of facepiece 2.

In fact, the air outflowing bilaterally from inflow chamber 37 is guided along the entire lower portion of facepiece 2, to be then conveyed to the upper portion of the same so as to flow laterally to eye-pieces 4 and to move toward the center of facepiece 2 with a centripetal motion.

In this situation, still with reference to the employment of the mask at low temperatures, the air would be further heated before reaching the upper part of the facepiece, so as to avoid any risk of freezing the user's face and to afford optimum characteristics necessary for a good de-clouding of eye-pieces 4.

Subsequently, air is conveyed into half mask 22 through connection means represented by single-acting valves 41 conventionally provided on the latter and functioning to prevent, in the next exhalation phase, the exhaled air from filling the free space between half mask 22 and facepiece 2.

Still with reference to the inhalation phase, the vacuum originated inside half mask 22 actuates outflow valve 24 so as to create a perfect adherence of diaphragm 24*a* on edge 24*c*. In this way, the air present in outflow chamber 35, communicating with the external atmosphere, is prevented from being sucked int half mask 22.

During the exhalation phase, the pressure produced in half mask 22 causes the closure of single acting valves 41 and the opening of outflow valve 24 further to the detachment of diaphragm 24*a* from edge 24*c*. The air outflowing from outflow opening 23 fills outflow chamber 35 and transfers heat to the wall of partition 34. The condensate consequently deposited on partition 34 is released through discharge duct 36.

Advantageously, partition 34 may be provided with a rib 42 extending vertically along a direction containing the axis of outflow valve 24 and having a terminal edge 42*a* situated near diaphragm 24*a*. Rib 42 reduces the opening of valve 24 to prevent a large part of the exhaled air from reaching communication opening or chamber 30 without skimming the wall of partition 34.

The exhaled air, flowing along outflow chamber 35, passes also on separation wall 32, cleaning it from contaminating agents which may have deposited thereon. At last, the exhaled air is discharged outside through communication opening 30 and protection grate 31, as indicated by arrow B in FIG. 1.

The present invention achieves its original objectives. In fact, the mask forming its subject matter is superior to the prior art with respect to functionality, practicality and comfort.

In particular, the arrangements adopted in respect of nozzle 11, in the lower portion of which is situated the filtering element, have yielded a better distribution of the various parts of the mask and have eliminated the disadvantages, occurring in the conventional masks of the above type, of the downward limitation of the visual field of the user.

Further, the position of the filter in the lower portion of the nozzle avoids the inconvenience in the prior art represented by the limitation of the efficiency of the phonic cap. Instead, the mask of the invention enhances its efficiency. In fact, in the mask according to the invention, sounds transmitted by the phonic cap may reach the external atmosphere directly through connection chamber 30. This has made possible a significant reduction in the size of the phonic cap, to the advantage of the single-acting outflow valve, which is provided with a circular diaphragm of comparatively large diameter.

Further, the novel structure of the nozzle prevents the inhaled air from flowing directly into the highest portions of the facepiece. This enables a pre-heating of the inhaled air, which results in turn in an improved de-clouding action of the eye-pieces and in the elimination of any risk of freezing the operator's face.

These results are enhanced by the particular construction of the facepiece and of the half mask, which appear able to induce the air to effect a long centripetal travel before reaching the eye-pieces. In particular, the structure of the outer portion of the facepiece permits the eye-pieces to be situated in close proximity to the user's eyes, so that he is able to use optical instruments with facility.

Another important advantage of the present invention is provided by the structure whereby the exhaled air is discharged in the external atmosphere without skimming the surface of the filtering element. In this way, the formation of ice on the latter, in the presence of low temperatures, can be prevented.

Further, the adoption of two different rubber compounds, vulcanized together to obtain the facepiece, gives rise to a very light and resistant structure of the overall mask without in any way diminishing its functional characteristics. Moreover, the presence of peripheral step portion 5a and of the supporting seat formed by first section 3b ensures the correct positioning of the hood of the protective garment on the mask.

It should be noted that the above description and the accompanying drawings are merely illustrative of the application of the principles of the present invention and are not limiting. Numerous other arrangements which embody the principles of the invention and which fall within its spirit and scope may be readily devised by those skilled in the art.

We claim:

1. A gas mask for operation in contaminated areas, comprising:

a facepiece;

a nozzle tightly engaged in a lower portion of said facepiece and having a front portion facing toward an outer environment and a rear portion joined together with said front portion and having a width smaller than the width of said front portion, said nozzle including an inflow opening having a fitting adapted to hold a filter, said inflow opening being located in a lower portion of said nozzle;

a half mask situated at an interior region of said facepiece, tightly engaged with said rear portion of said nozzle and provided with a terminal edge adapted to provide a seal around the user's nose and mouth, said inflow opening communicating with said interior region of said facepiece;

connection means for enabling passage of air from said interior region of said facepiece to an interior region of said half mask;

closing valve means for opening and closing said inflow opening;

an outflow opening placing said interior region of said half mask into communication with the outer environment, said outflow opening being located in a lower part of said rear portion substantially at the level of and behind said inflow opening;

a single-acting outflow valve for opening and closing said outflow opening;

a phonic cap housed in said nozzle and situated above said inflow opening and said outflow opening;

a communication chamber positioned within said nozzle at the level of said phonic cap and including communication holes to the outer environment;

an inflow chamber which opens bilaterally in said lower portion of said facepiece near opposite sides of said rear portion and is positioned between said inflow opening and said interior region of said facepiece to enable said inflow opening to be in communication with said interior region of said facepiece;

an outflow chamber positioned between said outflow opening and said communication chamber to enable said outflow opening to be in communication with the outer environment through said communication chamber, said communication chamber being located above said inflow opening and said outflow opening; and a partition located inside said nozzle and mutually separating said inflow chamber and said outflow chamber from each other, said partition being tightly connected with the peripheral extent of said rear partition and having a width smaller than said width of said front portion of said nozzle.

2. A gas mask as in claim 1, wherein said inflow opening and said outflow opening have axes which are mutually offset through an angle less than 15°.

3. A gas mask as in claim 1, further comprising a discharge duct extending from said outflow chamber and terminating below said inflow chamber, said discharge duct being located at a base of said nozzle.

4. A gas mask as in claim 1, wherein said partition comprises a rib which extends vertically along a direction intersecting the axis of said outflow opening and comprises a terminal edge located near said single-acting outflow valve.

5. A gas mask as in claim 1, further comprising a separation wall disposed between said phonic cap and said communication chamber, said separation wall comprising a plurality of holes distributed along concentric circumferences which are offset with respect to other circumferences along which are distributed holes provided in said phonic cap.

6. A gas mask as in claim 1, further comprising a protection grate removably engaged with said nozzle to provide said communication holes of said communication chamber.

7. A gas mask as in claim 1, wherein said half-mask comprises at least two guiding baffles situated over said inflow chamber, protruding toward said facepiece and extending symmetrically along said half-mask to prevent air coming out from said inflow chamber from reaching directly said upper portion of said facepiece.

8. A gas mask as in claim 1, wherein said facepiece comprises a front portion made of rubber and adapted to cover the user's face and a sealing skirting made of a rubber compound which is softer than said rubber of said front portion, said sealing skirting being joined at its periphery to said front portion to ensure a tight seal around the user's face.

9. A gas mask as in claim 1, wherein said facepiece comprises a peripheral step adapted to provide an abutment seat for the hood of a protective garment worn by the user.

10. A gas mask as in claim 8, wherein said facepiece comprises a step located at a surface at which said front portion and said sealing skirting are joined to reinforce said surface and to provide an abutment seat for the hood of a protective garment worn by the user.

11. A gas mask as in claim 1, wherein said facepiece comprises a profile cut off along a vertical median plane which includes a first front section adapted to provide a supporting seat to the edge of a hood associated with a protective garment worn by the user.

12. A gas mask as in claim 10, wherein said profile further comprises a substantially vertical second section adjacent to said first section which is adapted to provide a ridge at a level lower than a level of the user's pupils, said ridge providing a pinching protrusion adapted to be situated at the user's nose.

13. A gas mask as in claim 1, wherein said front portion, said rear portion and said partition are made of synthetic resin and are made integral by melting of material along their coupling surfaces.

* * * * *

UNITED STATES PATENT AND TRADEMARK OFFICE

CERTIFICATE OF CORRECTION

PATENT NO. : 4,961,420

DATED : October 9, 1990

INVENTOR(S) : Giulio CAPPA, et al.

It is certified that error appears in the above-identified patent and that said Letters Patent is hereby corrected as shown below:

ON TITLE PAGE: Assignee should read

-- [73] Assignee: INDUSTRIE PIRELLI S.p.A.; MINISTERO DELLA DIFESA DIREZIONE GENERALE A.M.A.T., both of Italy.--

Signed and Sealed this

Thirty-first Day of March, 1992

*Attest:*

HARRY F. MANBECK, JR.

*Attesting Officer*

*Commissioner of Patents and Trademarks*